US008888023B2

(12) United States Patent
Barton

(10) Patent No.: US 8,888,023 B2
(45) Date of Patent: Nov. 18, 2014

(54) SELF-RETAINING NOZZLE

(75) Inventor: Richard J. Barton, Vail, AZ (US)

(73) Assignee: Rain Bird Corporation, Azusa, CA (US)

( * ) Notice: Subject to any disclaimer, the term of this patent is extended or adjusted under 35 U.S.C. 154(b) by 954 days.

(21) Appl. No.: 12/574,107

(22) Filed: Oct. 6, 2009

(65) Prior Publication Data

US 2011/0079661 A1 Apr. 7, 2011

(51) Int. Cl.

| | |
|---|---|
| ***B05B 1/00*** | (2006.01) |
| ***B05B 15/10*** | (2006.01) |
| ***B05B 1/02*** | (2006.01) |
| *B05B 3/02* | (2006.01) |

(52) U.S. Cl.

CPC . *B05B 15/10* (2013.01); *B05B 1/02* (2013.01); *B05B 3/02* (2013.01)

USPC ..... 239/600; 239/397; 239/442

(58) Field of Classification Search

USPC ..... 239/390, 397, 442, 600

See application file for complete search history.

(56) References Cited

U.S. PATENT DOCUMENTS

| | | | | |
|---|---|---|---|---|
| 3,537,648 | A | | 11/1970 | Radecki |
| 3,799,453 | A | | 3/1974 | Hart |
| 3,924,809 | A | | 12/1975 | Troup |
| 4,161,286 | A | | 7/1979 | Beamer et al. |
| 4,177,944 | A | | 12/1979 | Wichman |
| 4,195,782 | A | | 4/1980 | Troup |
| 4,216,913 | A | | 8/1980 | Troup |
| 4,235,379 | A | | 11/1980 | Beamer |
| 4,434,937 | A | | 3/1984 | Pltchford |
| 4,496,103 | A | | 1/1985 | Pitchford |
| 4,498,626 | A | * | 2/1985 | Pitchford ..... 239/230 |
| 4,537,356 | A | | 8/1985 | Lawson |
| 4,595,141 | A | | 6/1986 | Cherundolo et al. |
| 4,625,914 | A | | 12/1986 | Sexton et al. |
| 4,632,312 | A | | 12/1986 | Premo et al. |
| 4,681,259 | A | | 7/1987 | Troup et al. |
| 4,787,558 | A | | 11/1988 | Sexton et al. |
| 5,090,621 | A | | 2/1992 | McMillen et al. |
| 5,240,182 | A | | 8/1993 | Lemme |
| 5,240,184 | A | | 8/1993 | Lawson |
| 5,299,742 | A | | 4/1994 | Han |
| 5,383,600 | A | | 1/1995 | Verbera et al. |
| 5,598,977 | A | | 2/1997 | Lemme |
| 6,095,432 | A | * | 8/2000 | Casagrande ..... 239/230 |
| 6,732,950 | B2 | | 5/2004 | Ingham et al. |
| 6,802,458 | B2 | | 10/2004 | Gregory |
| 6,929,194 | B2 | | 8/2005 | Lawson |
| 7,325,753 | B2 | | 2/2008 | Gregory et al. |
| 7,726,587 | B2 | | 6/2010 | Markley et al. |

FOREIGN PATENT DOCUMENTS

| | | | |
|---|---|---|---|
| WO | WO96/21513 | * | 7/1996 |

* cited by examiner

*Primary Examiner* — Christopher Kim

(74) *Attorney, Agent, or Firm* — Fitch, Even, Tabin & Flannery, LLP

(57) ABSTRACT

An irrigation sprinkler is provided having a nozzle and a turret for the distribution of irrigation water that includes a latching portion so that the nozzle may be detachably inserted into a nozzle socket of the turret. The nozzle may include radially flexible extensions with radial protrusions that interengage with corresponding lock seats of the nozzle socket to form a latching connection therewith. The latching connection restricts the nozzle from becoming unintentionally discharged from the nozzle socket. The nozzle may further be configured so that increased water pressure acting on the nozzle causes the radial protrusions to more tightly engage the nozzle socket to prevent unintentional discharge of the nozzle.

19 Claims, 11 Drawing Sheets

SELF-RETAINING NOZZLE

FIELD OF THE INVENTION

This invention relates generally to irrigation devices and, more particularly, to self-retaining nozzles for irrigation sprinklers.

BACKGROUND

In a typical irrigation system, a plurality of sprinklers are provided for distributing water to irrigate a selected terrain area. One type of irrigation sprinkler is a pop-up irrigation sprinkler. Pop-up irrigation sprinklers are typically buried in the ground and include a stationary housing and a riser assembly, mounted within the housing that cycles up and down during an irrigation cycle. During an irrigation cycle, the riser assembly is propelled through an open upper end of the housing and projects above ground level, or "pops up," to distribute water to surrounding terrain. More specifically, pressurized water is supplied to the sprinkler through a water supply line attached to an inlet of the housing. The pressurized water causes the riser assembly to travel upwards against the bias of a spring to the elevated spraying position above the sprinkler housing to distribute water to surrounding terrain through one or more spray nozzles. When the irrigation cycle is completed, the pressurized water supply is shut off and the riser is spring-retracted back into the sprinkler housing so that the housing and riser assembly are again at and below ground level.

A rotary sprinkler commonly includes a rotatable turret mounted at the upper end of the riser assembly. The turret typically includes one or more spray nozzles for distributing water and is rotated on an adjustable arcuate part-circle or full circle water distribution pattern.

Rotary sprinklers commonly include a water-driven motor to transfer energy of the incoming water into a source of power to rotate the turret. One common mechanism uses a water-driven turbine and a gear reduction system to convert the high speed rotation of the turbine into relatively low speed turret rotation. Some examples of rotary sprinklers include the sprinklers described in U.S. Pat. Nos. 4,625,914; 4,787,558; 5,383,600; 6,732,950; and 6,929,194 all assigned to the assignee of this application, Rain Bird Corporation.

Rotary sprinklers are designed to accept a variety of nozzles depending on the desired range and spray coverage of the emitted stream of irrigation water. Some nozzles make use of multiple nozzles or nozzle outlets providing varying water flow characteristics and trajectories. These rotary sprinklers commonly include a cavity in the form of a nozzle socket for slide-fit reception of nozzles. The nozzle socket allows a user to remove and replace the nozzles when a nozzle offering different flow or trajectory characteristics is desired or if a nozzle becomes damaged during use. Nozzles are typically retained in the nozzle socket by use of one or more retainer screws that may be inserted into the turret to hold the nozzle in place and which may be removed for removal of the nozzle. In one such system, the screw may be a diffuser screw positioned at the nozzle discharge end to retain the nozzle and restrict it from becoming discharged from the opening of the nozzle socket when subjected to fluid pressure, while at the same time acting as an adjustable stream diffuser by being positioned with at least a portion of the screw extending into the flow path of the water stream. A water stream exiting a sprinkler is energized to reach a relatively far throw distance, but often causes a donut pattern of watering around the sprinkler because only a small amount of the energized water falls to the terrain along the radius adjacent to the sprinkler. Thus, the diffuser screw acts to retain the nozzle within the nozzle socket and to interrupt an upper portion of the water stream, de-energizing the portion and causing it to fall through the water stream to water the terrain in a radius generally adjacent to the sprinkler.

While current nozzle retention methods are generally suitable for ordinary operation of the sprinkler, these methods tend not to work in all situations. For example, if a screw retaining the nozzle within the nozzle socket is also used as a stream diffuser, a user, while attempting to adjust the length of the screw extending into the water path, may inadvertently remove the screw from its retaining engagement of the nozzle. Because typical nozzles held within nozzle sockets cannot generally withstand water pressures above about 30 psi when the diffuser screw is not in retaining engagement with the nozzle, a nozzle under these circumstances may become unintentionally discharged from the nozzle socket under typical operation pressures of about 40-50 psi. Moreover, during particularly harsh operations of the sprinkler system, like winterization processes, wherein nozzles may be subjected to unusually high pressures of up to 100 psi, the nozzle may become unintentionally discharged from the nozzle socket. For example, this may occur because the frictional forces are not sufficient or the retaining screw may be out of position. Each of these situations may cause inconvenience and potential added expense to a user who may be required to search for a discharged nozzle or replace the nozzle if it cannot be located. Additionally, improvements in nozzle outlets have provided for close range watering without the use of a diffuser screw. Thus, in some situations, it may be desirable to use a sprinkler without a diffuser screw which may de-energize the water stream, reducing the sprinkler's range.

Therefore, there exists a need for a nozzle for an irrigation sprinkler that can be quickly and easily installed and removed from the sprinkler. Further, there is a need for a nozzle that can be securely mounted to the sprinkler without becoming unintentionally discharged during normal operation and maintenance of the irrigation and without the need for a diffuser screw.

DESCRIPTION OF THE PREFERRED EMBODIMENTS

Figure 1:
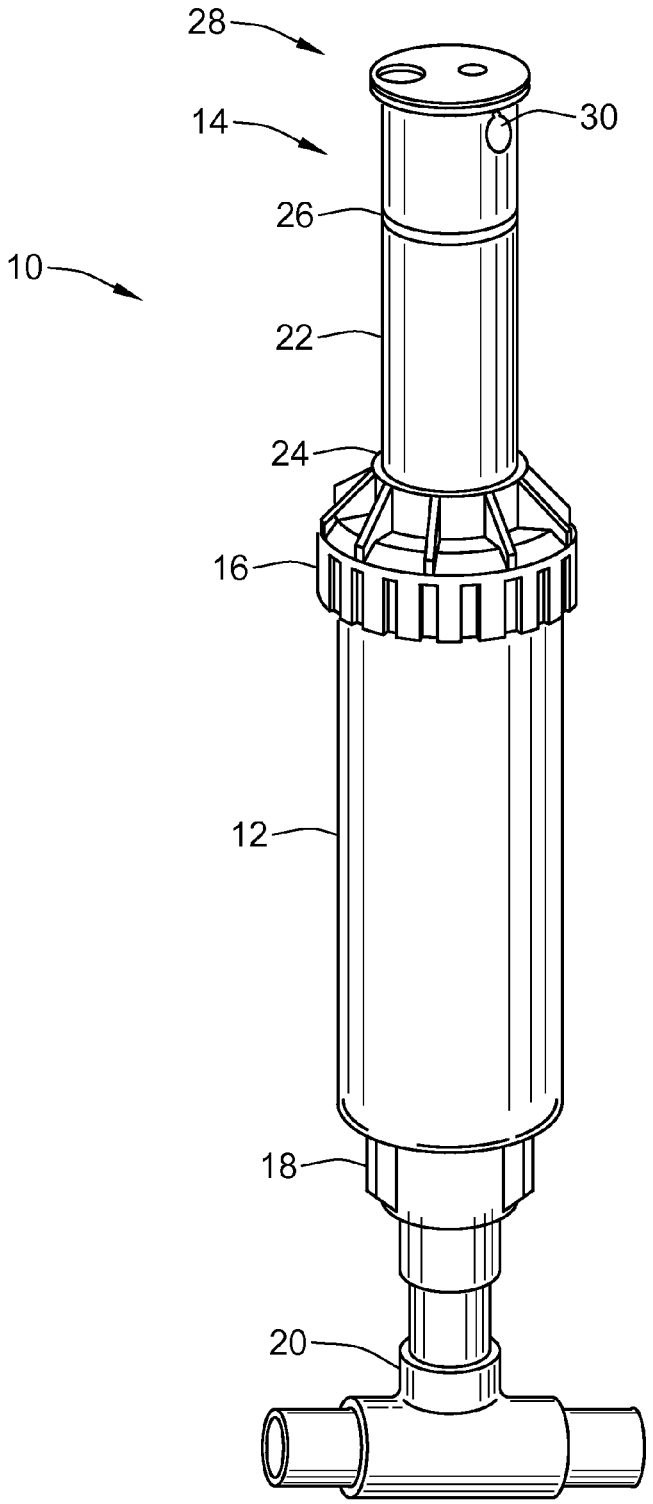
FIG. 1 is a perspective view of an irrigation sprinkler embodying features of the present invention with a riser assembly in an elevated position for distributing water therefrom.

As shown in FIG. 1, a rotary pop-up sprinkler 10 is generally provided having a housing 12 and a riser assembly 14. The tubular riser assembly 14 is a pop-up riser that reciprocates between a spring-retracted position (not shown) and an elevated watering position, as shown in FIG. 1, in response to water pressure. More specifically, when the supply water is pressurized for a watering cycle, the riser assembly 14 extends ("pops up") above ground level so that water can be distributed to the surrounding terrain for irrigation. When the water is shut off at the end of a watering cycle, the riser assembly 14 retracts into the housing 12 where it is protected from damage.

The housing 12 provides a protective covering for the riser assembly 14 and serves as a conduit for incoming water under pressure. The housing 12 preferably has the general shape of a cylindrical tube and is preferably made of a sturdy lightweight injection molded plastic or similar material. The housing 12 has an upper end 16 and a lower end 18 defining an inlet that is threaded to connect to a correspondingly threaded outlet of a water supply pipe 20; however, other attachment formats are also possible. The sprinkler 10 may be one of a plurality of coordinated sprinklers 10 in an irrigation network.

The riser assembly 14 includes a non-rotatable stem 22 with a lower end 24 and an upper end 26. A turret 28 is mounted on the upper end 26 of the stem 22. The turret 28 rotates relative to the housing 12 and the stem 22 to water a predetermined arcuate pattern manually adjustable from generally 0 degrees to 360 degrees. The sprinkler 10 may include a reversing gear drive mechanism at the interface between the turret 28 and the stem 22 that switches the direction of rotation of the turret 28 to create the desired arcuate sweep or, in some cases, permits the turret 28 to continue in a single direction for 360 degree watering. An arc adjustment member allows an operator to manually adjust the arcuate sweep settings.

A drive assembly is mounted within the stem 22 and rotates the turret 28. The water pressure supplied to the sprinkler 10 preferably provides the power for rotationally driving the turret 28, although other conventional ways of providing power to the turret 28 may be used. The drive assembly preferably includes a water driven turbine and a gear reduction assembly, which are operatively coupled to rotate the turret 28. The turret 28 includes a water discharge outlet 30 preferably fitted with a removable nozzle for providing the pressurized water to the surrounding terrain.

Figure 2:
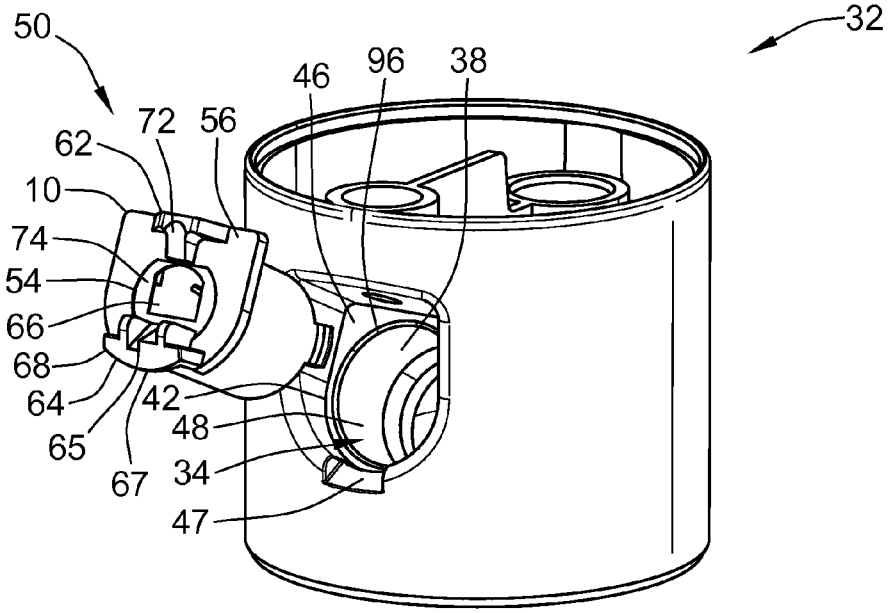
FIG. 2 is an exploded perspective view of a turret and nozzle of the irrigation sprinkler of FIG. 1.
Figure 6:
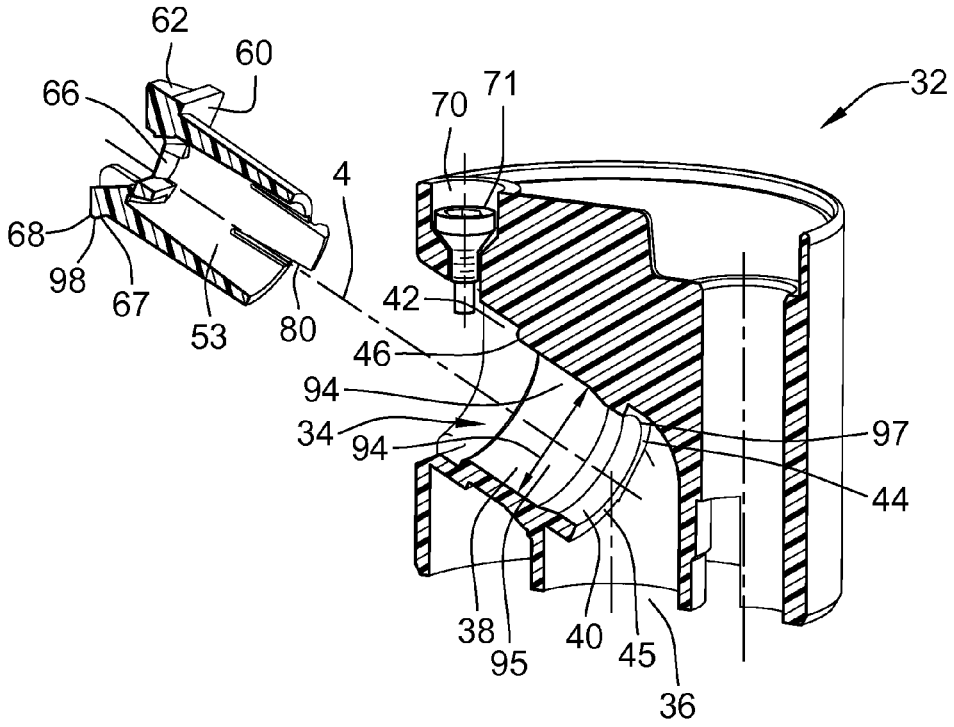
FIG. 6 is an exploded perspective cross-sectional view of the turret and nozzle of FIG. 2.
Figure 7:
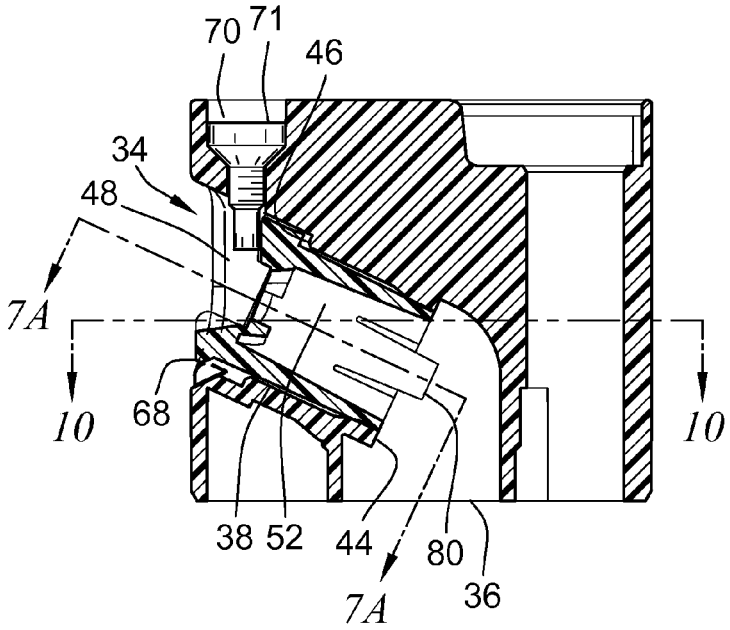
FIG. 7 is a side elevation cross-sectional view of the turret and nozzle of FIG. 2 the nozzle inserted into the turret.
Figure 7A:
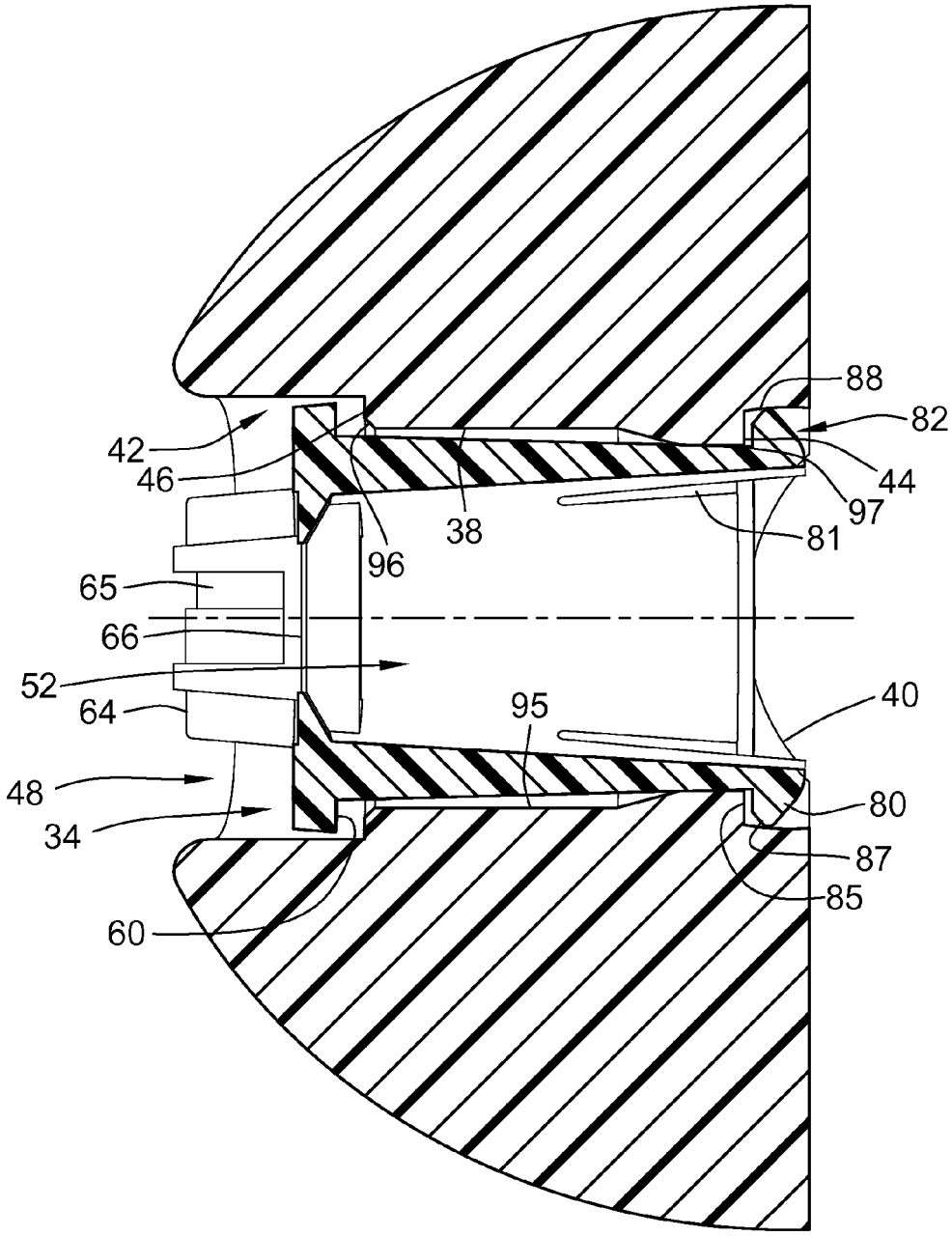
FIG. 7A is the cross-sectional view of the turret and nozzle of FIG. 7 taken along line 7A-7A of FIG. 7.
Figure 7B:
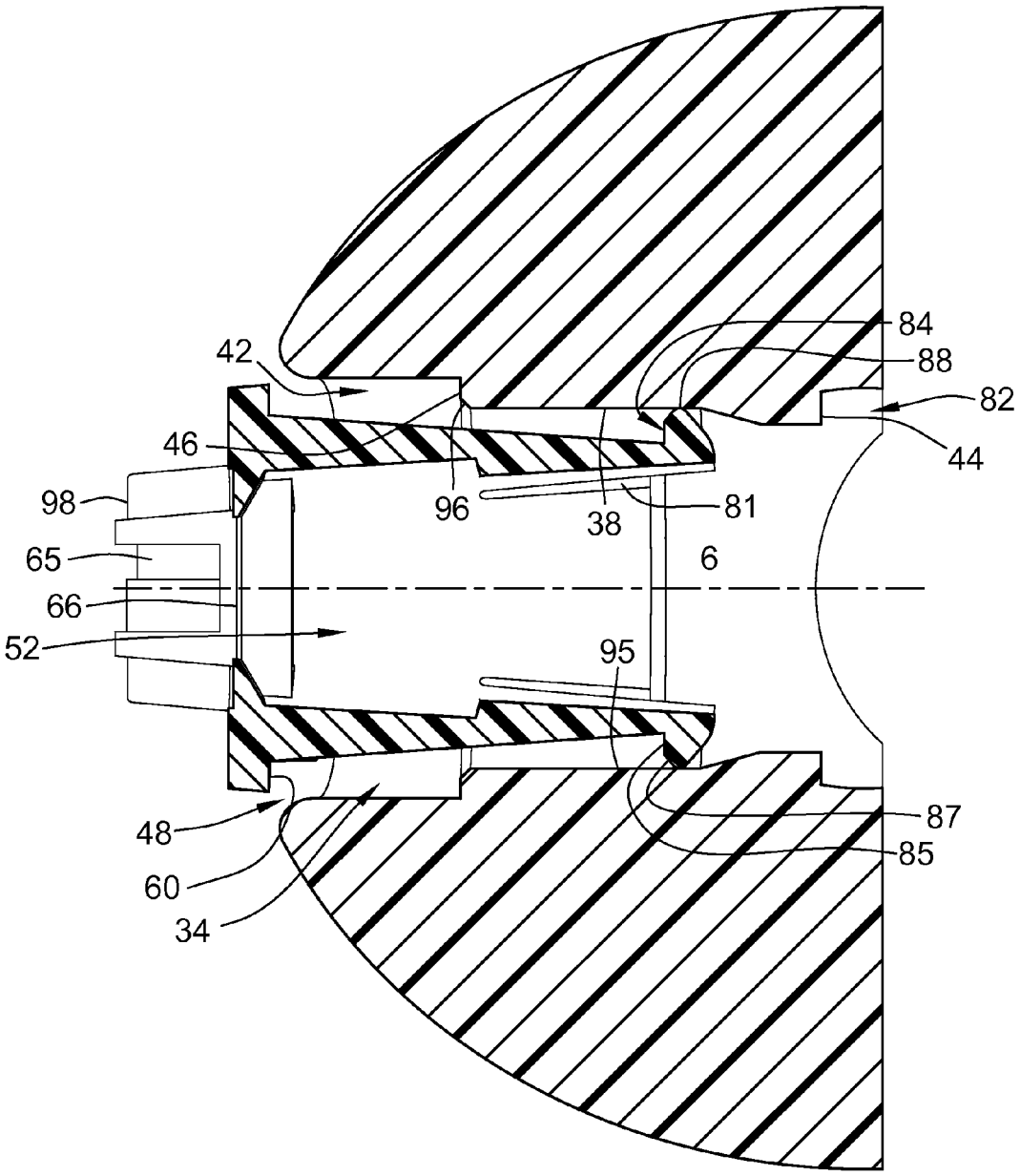
FIG. 7B is the cross-sectional view of 7A with the nozzle partially removed.
Figure 8:
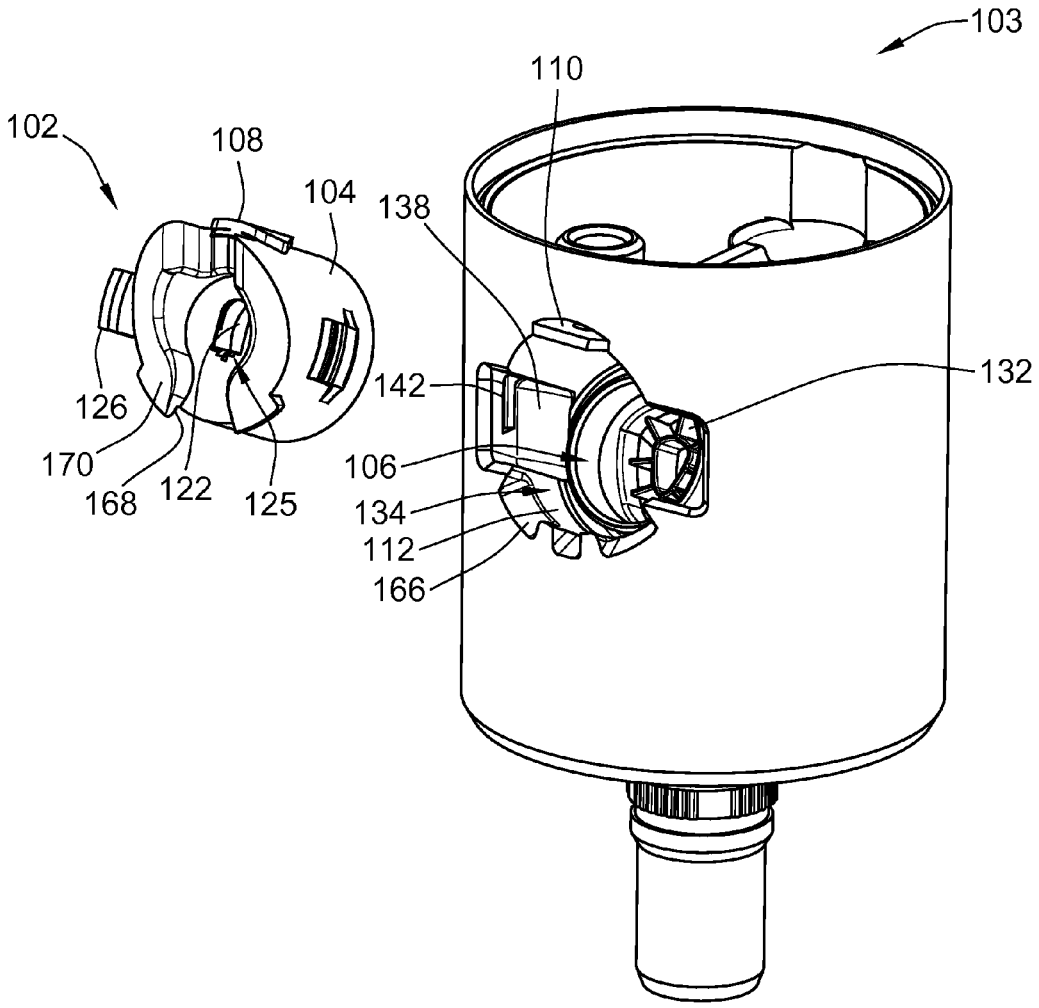
FIG. 8 is an exploded perspective view of an alternate turret and nozzle for the irrigation sprinkler of FIG. 1.
Figure 9:
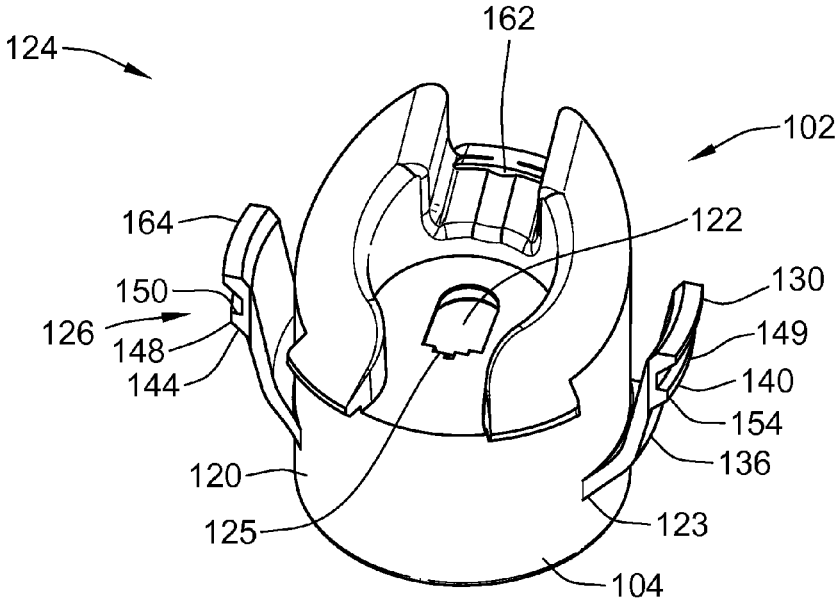
FIG. 9 is a perspective view of the nozzle of FIG. 8.
Figure 9A:
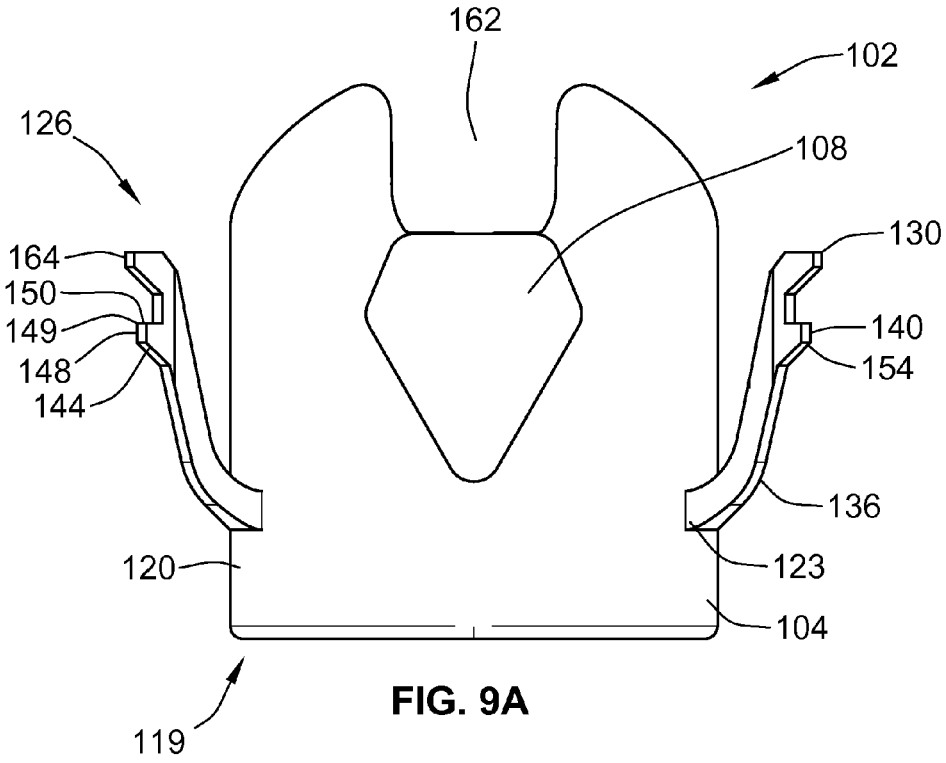
FIG. 9A is a top view of the nozzle of FIG. 8.

As shown in FIGS. 2, 6, and 7, according to one approach, a turret 32 has a generally cylindrical shape. The turret 32 includes a nozzle socket 34 at the water discharge outlet 30 in fluid communication with a fluid intake portion 36, the nozzle socket 34 and fluid intake portion 36 defining a fluid flow path. The nozzle socket 34 has a generally cylindrically shaped inner surface 38 and an upstream end 40 and a downstream end 42. The upstream end 40 includes a generally annular end surface 44. The downstream end 42 has a forwardly presented end surface forming a nozzle seat 46 and a generally U-shaped opening 48 so that upon slide-fit insertion of a nozzle 50 into the nozzle socket 34, the nozzle 50 has a generally upwardly inclined orientation.

Figure 3:
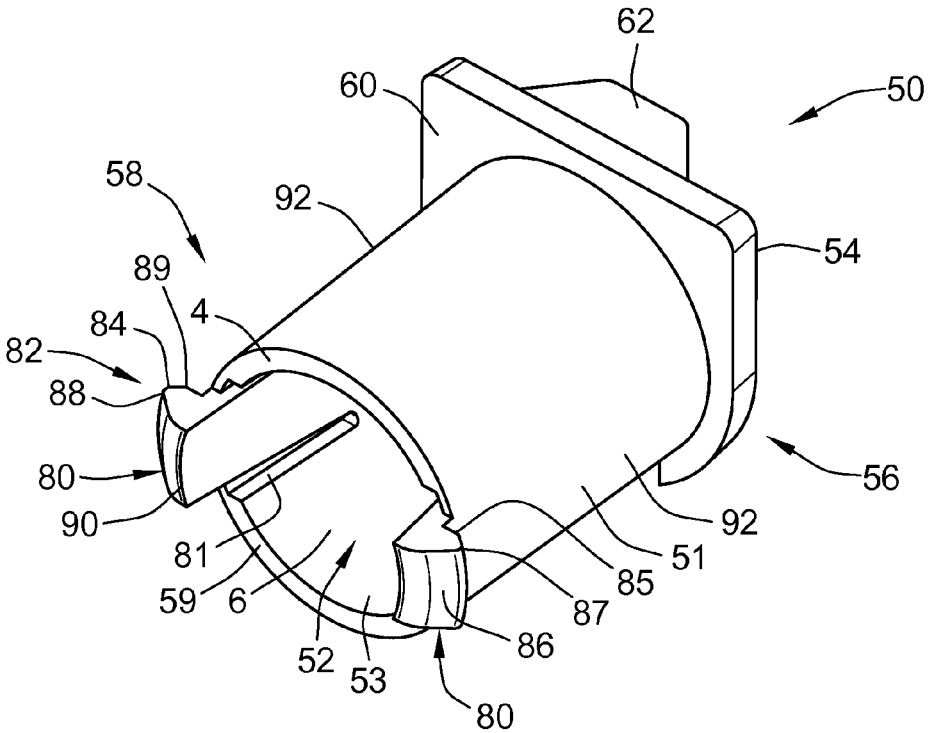
FIG. 3 is a perspective view of the nozzle of FIG. 2.
Figure 4:
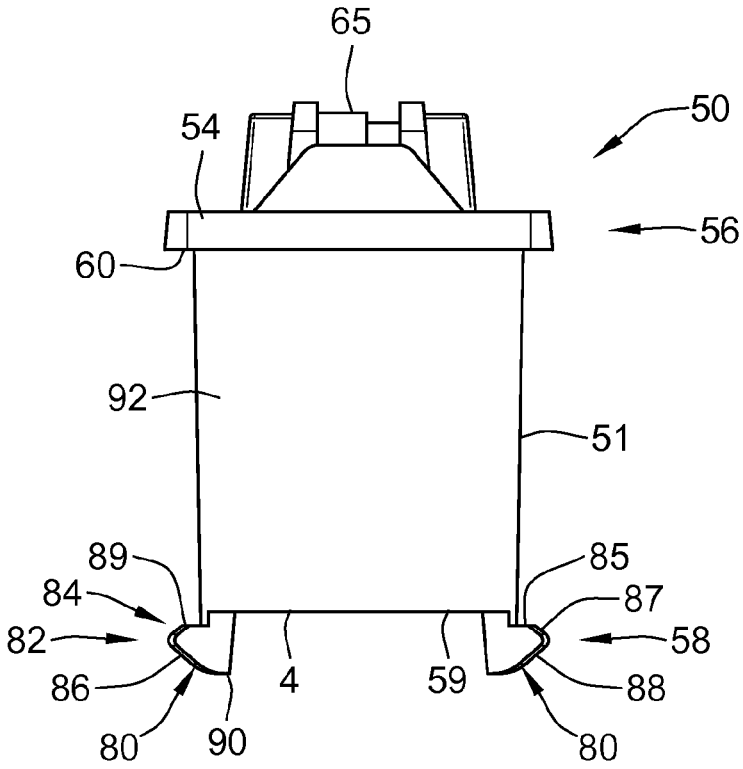
FIG. 4 is a top view of the nozzle of FIG. 2.
Figure 5:
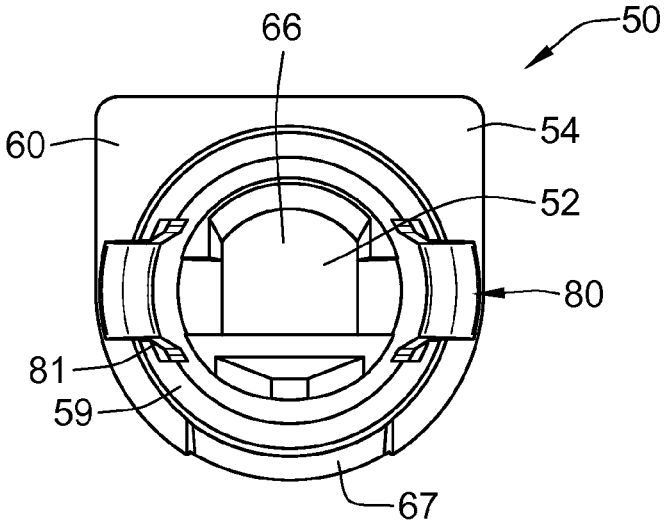
FIG. 5 is a rear elevation view of the nozzle of FIG. 2.

In this approach, a nozzle 50, as shown in FIGS. 3-5, has a generally cylindrical body 51 defining a hollow flow path 52, and has a size and shape for mating in slide-fit reception into the nozzle socket 34. Specifically, the nozzle 50 has a generally U-shaped face 54 at a downstream end 56 that extends radially further than the diameter of the nozzle body 51 providing an outboard contact surface 60 for abutting against the nozzle seat 46 of the turret 32 when the nozzle 50 is inserted in the nozzle socket 34. The nozzle face 54 also may include an upper extension 62 and a lower extension 64 for forming an irrigation water stream from the nozzle 50. Specifically, the lower extension 64 may include a stepped spray surface 65 for defining a portion of the water stream angled generally downwardly to water terrain at a radius near the sprinkler 10. The nozzle 50 also includes an upstream end 58 with an annular end surface 59. A threaded adjustment screw 71 (FIGS. 6 and 7) also may be mounted on the turret 32 within a threaded bore 70 so that the threaded shank thereof extends downwardly through a forwardly open notch 72 formed in the upper extension 62 for removably retaining the nozzle 50 seated within the nozzle socket 34. The adjustment screw also may be adjustably positioned for advancing a tip thereof into interrupting engagement with an upper portion of the projected water stream.

The nozzle face inboard portion 74 defines a generally tombstone shaped nozzle outlet 66 having an opening that is typically smaller than the hollow flow path 52 for forming and projecting a stream of irrigation water from the nozzle outlet 66 during operation of the sprinkler 10. Various sizes and shapes of nozzle openings may be used for the nozzle 50 depending on the desired throw distance and spray pattern. Moreover, while the nozzle is shown having one outlet 66, the nozzle 50 may include a plurality of nozzle outlets 66 for projecting streams of water with different flow characteristics and trajectories.

A pair of self locking latches in the form of axial extensions 80 extend axially upstream from the nozzle upstream end 58. The axial extensions each have a terminal end formed with a radial protrusion in the form of a two-way barb 82 having a lead-in cam surface 86 angled downstream and an upstream side 84 including an inner lock surface 85 and an outer lead-out cam surface 87. The barb outer edges 88 extend radially further in diameter than an outer surface 92 of the nozzle body 51. Referring to FIG. 6, the nozzle socket has a diameter 94 that is smaller than the distance between the outer edges 88 when the axial extensions 80 are in their naturally outwardly biased position.

The lead-in cam surfaces 86 extend generally angle inward in an upstream direction at an angle from the outer barb edges 88 to the lead-in cam surface inner edges 90. In one approach, the lead-in cam surfaces are angled inward in an upstream direction at approximately 56 degrees relative to the water flow path. The inner edges 90 are laterally spaced closer than the diameter of an inner lip 96 of annular seat 46 and the outer edges 88 are laterally spaced further apart than the diameter of the inner lip 96 and a drive surface 95 defined by the nozzle socket inner surface 38. Upon inserting the nozzle 50 into the nozzle socket 34 with sufficient pressure, the lead-in cam surfaces 86 contact the inner lip 96 of the annular seat 46 causing the lead-in cam surfaces 86 to ride along the inner lip 96 of the annular seat 46 urging the axial extensions 80 to flex radially inwardly until the outer edges 88 of the barbs clear the inner lip 96 and begins to ride along the nozzle socket drive surface 95. Upon further insertion, the barbs 82 continue to ride along the drive surface 95 with the axial extensions 80 remaining inwardly flexed until the barbs 82 reach the upstream end 40 of the nozzle socket 34. After the barbs 82 and specifically the locking surfaces 85 pass over the inner lip 97 of annular end surface 44, the axial extensions 80 resiliently snap back away from each other into their naturally, outwardly biased orientation with the barbs 82 positioned upstream of the annular end surface 44 and with the outer edges 88 positioned radially outward from the nozzle socket inner surface 38 in the larger diameter fluid intake portion 36. So situated, the barbs 82 and specifically the downstream side 84 thereof form a snap-fit connection with the annular end surface 44 of the nozzle socket. The distance between the outboard contact surface 60 of the nozzle face 54 and lock surfaces 85 of the barbs 82 is greater than the distance between the nozzle seat 46 and the annular end surface 44 providing a tolerance when the nozzle is inserted into the nozzle socket 34. This ensures that the nozzle 102 can be inserted far enough upstream in the nozzle socket 34 so that the barbs 82 can clear the end surface 44 during insertion of the nozzle 50 when the axial extensions 80 are inwardly flexed.

During operation, with the nozzle 50 snap-fit into the nozzle socket 34, the barbs 82 form a detachable connection with the end surface 44 and are positioned upstream therefrom. So situated, the lock surfaces 85 of the downstream side 84 engage the end surface 44 to restrict downstream movement of the nozzle 50 from the nozzle socket 34 during operation and maintenance.

As mentioned above, each barb downstream side 84 includes an inner lock surface 85 oriented generally orthogonally to the water flow path and an outer lead-out cam portion 87 angled generally downstream from the barb outer edges 88 to a juncture 89 with the lock surface 85. In one example, the lead-out cam portions 87 are angled inward in a downstream direction at about 59 degrees relative to the water flow path. During operation or maintenance, pressurized fluid flowing through the water flow path 52 urges the nozzle 50 downstream toward the nozzle discharge outlet, urging the downstream side 84 of barbs 82, and specifically the lock surfaces 85 thereof, to tightly engage the end surface 44 of the nozzle socket 34 restricting the barbs 82 from passing thereover, thus restricting the nozzle from becoming discharged from the nozzle socket 34. The lock surfaces 85 should have sufficient radial extent to restrict them from passing over the annular end surface 44 under typical operation and maintenance conditions and pressure, but not too long to allow the lock surfaces 85 to pass over the annular end surface 44 for intentional removal of the nozzle 50 when the sprinkler 10 is not in operation. In one example, the radial extent of the lock surfaces 85 is about 20/1000 of an inch. The nozzle according to this example may be retained within the nozzle socket 36 under elevated pressures, such as, for example, above about 100 psi for several minutes and under operating pressures, such as, for example, about 50-55 psi for over 800 minutes, while still allowing an operator to extract the nozzle 50 from the nozzle socket 36 when the sprinkler 10 is not operating.

Moreover, pressure from irrigation water or other fluid flowing through the flow path of the nozzle 50 exerts a radially outward force on the axial extensions 80 restricting the extensions 80 from flexing inwardly during operation of the sprinkler 10 so that the lock surfaces 85 of the locking surfaces 84 remain overlapped and tightly engaged with the end surface 44 of the nozzle socket 34 and do not pass thereover during operation so that the nozzle 50 will not become unintentionally discharged from the nozzle socket 34.

On the other hand, as mentioned above, the radial extent of the lock surface 85 is sufficiently short to allow the lock surfaces 85 to pass over the end surfaces 44 when the sprinkler 10 is not in use and it is desirable to remove the nozzle for maintenance or to change the nozzle. Additionally, the locking surface lead-out cam portions 87 are angled inward in the downstream direction to facilitate removal of the nozzle 50 from the nozzle socket 34. To remove the nozzle 50, a user may insert a tool (such as a regular style screwdriver head) into a pry gap formed between a recess 47 at the bottom of the nozzle socket opening 48 and a pry surface 67 located on an outboard portion 68 of the nozzle lower extension 64. Upon the user applying a sufficient downstream pressure on the pry surface 67, with the tool pivoting off of the recess 47, the axial extensions 80 will flex slightly inward until the corner juncture 89 between the lock surfaces 85 and the lead-out cam portions 87 of the locking surfaces 84 passes inwardly over the inner lip 97 of the annular end surface 44. Further outward pressure causes the lead-out cam portions 87 to ride along the inner lip 97 urging the axial extensions 80 to flex radially inwardly until the outer edges 88 pass over the inner lip 97 and ride along the drive surfaces 95. With the axial extensions 80 pinched radially toward each other, the nozzle 50 may be pulled from the opening of the nozzle socket 34 until the nozzle 50 is completely removed and the axial extensions 80 resiliently snap back away from each other into their naturally outwardly biased orientation. Removal of the nozzle 50 from the nozzle socket 34 is achieved when the sprinkler 10 is not in operation because pressurized fluid will not be acting radially outwardly on the axial extensions 80, which allows the fingers 80 to flex inwardly so that the lock surfaces 85 may pass over the end surface 44.

The nozzle 50 may include inner extension grooves 81 extending axially downstream from the upstream face 59 of the nozzle 50 in the inner surface 53 of the nozzle 50. The grooves 81 may be aligned at the longitudinal edges of the axial extensions 80. So configured, the grooves 81 facilitate inward radial flexing of the axial extensions 80 by reducing the thickness of the material of the nozzle body that must be deformed to flex the axial extensions 80. Thus, the grooves 81 facilitate easier insertion and removal of the nozzle 50 from the nozzle socket 80 by a user.

In another approach as illustrated in FIGS. 8-11B, a nozzle 102 as generally described in U.S. Pat. No. 7,325,753, assigned to the assignee of the present application, and incorporated in its entirety herein by reference, includes a generally cylindrical body 104 having a size and shape for slide-fit reception into a generally cylindrical nozzle socket 106 formed at the water discharge outlet of a sprinkler turret 103. The nozzle 102 also may include generally cylindrical inner flow body 105. The nozzle socket 106 is in fluid communication with a fluid intake portion 109 of the turret 103, and the nozzle socket 106 and the fluid intake portion 109 define a fluid flow path. An upper key 108 may be formed on the body 104 at a top or upper side thereof for slide-fit reception into a complimentary shaped keyway 110 at the top of the nozzle socket 106. The key 108 and keyway 110 for rotationally orient the nozzle 102 in the nozzle socket 106. With the nozzle 102 mounted in the nozzle socket 106, the nozzle 102 defines a flow path 116 which is aligned with a water flow path extending through the fluid intake portion 109 of the turret 103.

Figure 10:
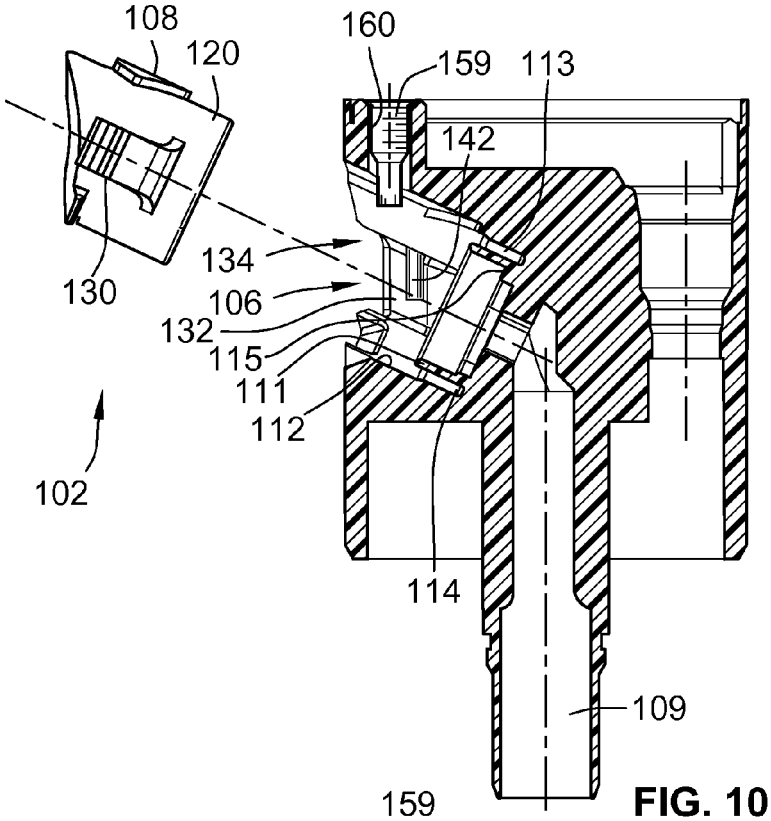
FIG. 10 is a an exploded perspective partial cross-sectional view of the turret of FIG. 8 with the nozzle removed.
Figure 11:
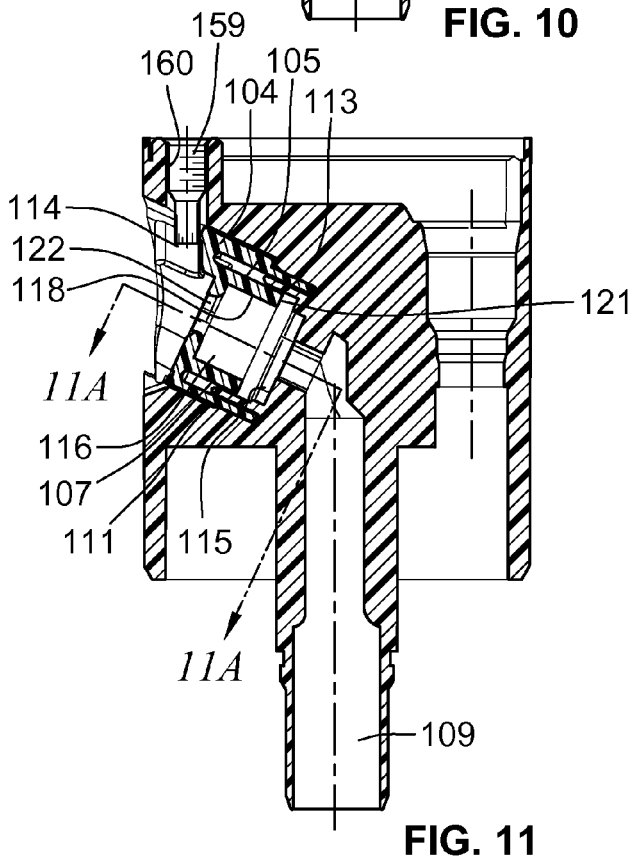
FIG. 11 is a side elevation cross-sectional view of the turret and the nozzle of FIG. 8 with the nozzle inserted into the turret.

More specifically, as shown in FIGS. 10 and 11, the nozzle body 104 and the flow body 105 define an annular gap 107 therebetween. Similarly, the nozzle socket 106 includes a tubular extension 111 generally concentric with the nozzle socket inner surface 112 defining an annular gap 113 therebetween. An outer nozzle stop 114 is formed at the base of the gap 113, while an inner nozzle stop 115 is formed by an annular surface 117 extending radially inward from the base of the tubular extension 111. With the nozzle 102 inserted into the nozzle socket 106 in an operating position (FIG. 11A), a small gap is formed between upstream end 119 of the nozzle body 104 and the outer nozzle stop 114 and between the upstream end 121 of the flow body 105 and inner nozzle stop 115 with the tubular extension 111 of the nozzle socket 106 extending at least partially into the gap 107 between the nozzle body 104 and the flow body 105 forming a flow discourager configuration to restrict water from flowing between the nozzle 102 and the nozzle socket 106 outside of the water flow path 116.

The nozzle includes an inner surface 118 of flow body 105 forming the flow path 116. When water under pressure is coupled to the sprinkler 10, this water travels through the hollow flow path 116, which produces a desired outwardly projected water stream for irrigating the surrounding terrain area through a nozzle outlet 122. The nozzle outlet may include a stepped lower edge 125 for directing a portion of the water stream to a terrain area in close proximity to the sprinkler. While a single tombstone shaped nozzle opening is shown, the nozzle 102 may include multiple openings or openings having varying shapes and sizes to produce desired water stream characteristics.

The nozzle 102 includes a pair of self-locking latches in the form resilient lateral extensions 126 positioned on generally opposite sides of the nozzle body 120. Each lateral extension 126 extends in the downstream direction and generally acutely relative to the outer surface 120 of the nozzle body 104. More specifically, each lateral extension extends from its generally upstream point of attachment 123 on the nozzle body 104 in a direction generally radially outward and longitudinally downstream thereof so that the lateral extension terminal ends 130 are positioned further apart than the diameter of the outer surface 120 of the nozzle body 104. The lateral extensions 126 are sized and shaped to inter-engage with a snap-fit connection with a pair of corresponding finger channels 132 defined by the turret 103 on opposite sides of the nozzle socket opening 134.

Figure 11A:
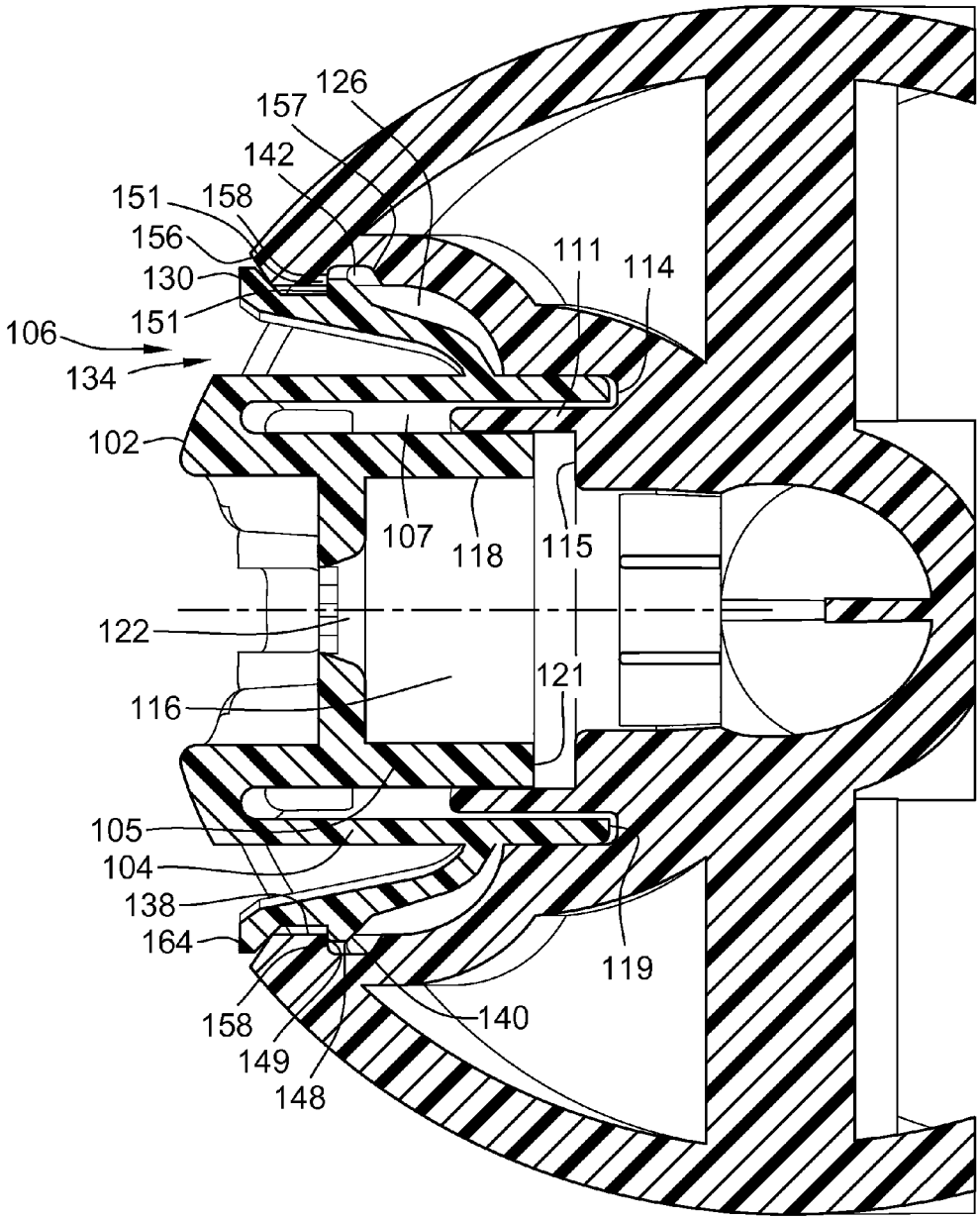
FIG. 11A is cross-sectional view of the nozzle and turret of FIG. 11 taken along line 11A-11A of FIG. 11.
Figure 11B:
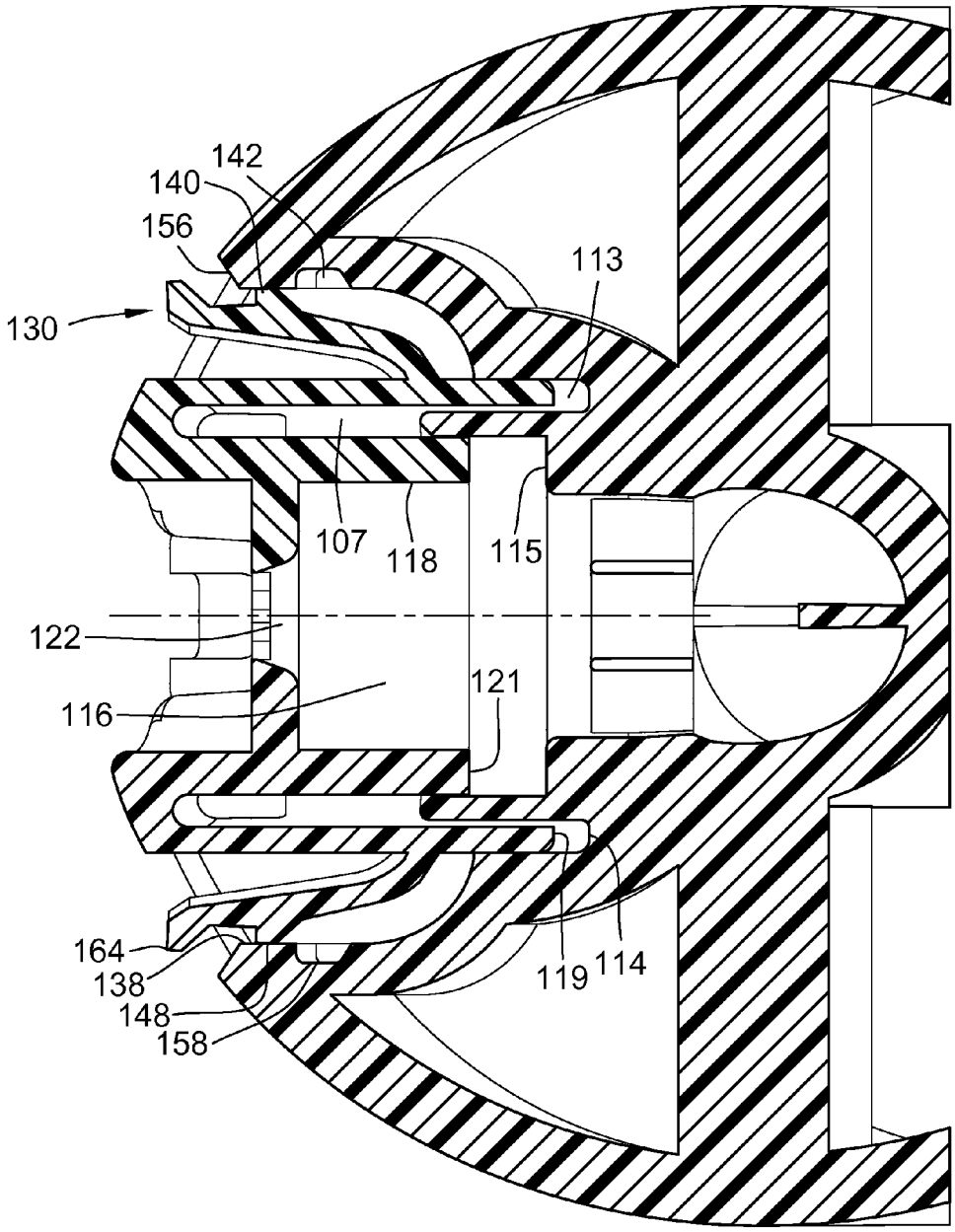
FIG. 11B is the cross-sectional view of 11A with the nozzle partially removed from the turret.

More specifically, the lateral extensions 126 include generally ramped outer surfaces 136 corresponding to lateral channel drive surfaces 138. Additionally, radial protrusions in the form of one-way barbs 140 extend radially outward from the lateral extension outer surfaces 136 at a location between the points of attachment 123 and the terminal ends 130 and are sized and configured for snap-fit engagement with corresponding lock grooves 142 located along the lateral channel drive surfaces 138. The barbs 140 include upstream lead-in cam surfaces 144 extending at an angle upstream from an outer edge 148 to the outer surface 136 and downstream lock surfaces 150 extending generally orthogonally to the flow path from the outer edge 148 to the outer surface 136. Referring to FIG. 11B, with the lateral extensions 126 in their naturally outwardly biased position, the distance between the channel drive surfaces 138 is smaller than the distance between the outer edges 148 of the barbs 140 so that the lateral extensions 126 must be pinched toward one another to provide clearance for the barbs 140 to pass over the channel drive surfaces 138 during insertion and removal of the nozzle 102.

Upon insertion of the nozzle 102 into the nozzle socket 106, the lateral extension outer surfaces 136 engage the channel drive surfaces 138, urging the lateral extensions 126 radially inward toward each other. As the nozzle 102 is inserted further into the nozzle socket 106, the lead-in cam surfaces 144 engage a downstream angled outer lip 156 of the opening 134 and ride therealong, which urges the extensions 126 to flex further radially inward until the barb outer edges 148 clear an inward edge of the outer lip 156, as illustrated in FIG. 11B, so that the outer edges 148 ride along the channel drive surfaces 138. When the nozzle 102 is completely inserted into the nozzle socket 106, downstream corner junctures 149 of outer edges 148 clear the inner edges 151 of the lock seats 158 of the lock grooves 142 allowing the lateral extensions 126 to resiliently snap outwardly so that the barbs 140 become in snap fit locking engagement with the lock grooves 142, as illustrated in FIG. 11A. Moreover, the lock grooves 142 have a width between a downstream lock seat 158 and an upstream surface 157 that is wider than the width of the barbs 140 to provide clearance for the barbs 140 to snap into the lock grooves 142 upon insertion of the nozzle 102. Additionally, as described above, a slight gap remains between upstream end 119 of the nozzle body 104 and the outer nozzle stop 114 and between the upstream end 121 of the flow body 105 and inner nozzle stop 115 with the nozzle 102 in its operating position. Thus, during insertion, the nozzle 102 may be inserted into the nozzle socket 106 upstream, past its operating position, to provide clearance for the barbs 140 to clear downstream lock seat 158 and snap into the lock grooves 142.

During normal operation of the sprinkler 10 or during maintenance operations, pressurized irrigation fluid flowing through the flow path 116 may exert a force on the nozzle 102 urging it in a direction of discharge from the nozzle socket opening 134. The pressure causes the lock surfaces 150 to engage the lock seats 158 of the lock grooves 142, which prohibits the fluid pressure from moving the nozzle 102 downstream and unintentionally discharging the nozzle 102 from the nozzle socket 106. Reaction forces exerted by the lock seats 158 on the lock surfaces 150 may be resolved into axial and radial components. The axial component restricts the downstream axial movement of the nozzle 102, while the radial component acts radially outwardly on the lateral extensions 126 to maintain the extensions 126 in their outwardly biased orientation so that the barbs 140 remain in the lock grooves 142 during operation and maintenance. Thus, the nozzle 102 is securely held in place by the snap-fit connections between the lateral extensions 126 and the lateral channels 134. In one example, the lock surfaces 150 can maintain the nozzle 102 in the nozzle socket under elevated pressures, such as, for example, above about 100 psi, for at least several minutes and under operating pressures, such as, for example, about 50-55 psi for at least about 800 minutes, while still allowing an operator to extract the nozzle 102 from the nozzle socket 36 when the sprinkler 10 is not operating.

A threaded diffuser screw 159 also may be mounted on the turret 103 within a threaded bore 160 so that the threaded shank thereof extends downwardly through a downstream facing open notch 162 formed in the nozzle body 104 for additional retention of the nozzle 102 within the nozzle socket 106. As described above, the diffuser screw 159 also may be adjustably positioned for advancing a tip thereof into interrupting engagement with an upper portion of the projected water stream to adjust the water stream characteristics and range.

To remove the nozzle 102 for replacement with a different nozzle or maintenance, an operator's fingers may be inserted partially into the finger channels 134 to grasp the finger tabs 164 located at the terminal end of the lateral extensions 126 to pinch the lateral extensions 126 toward each other. Upon sufficient inwardly flexing, the upper edges 154 of the lock surfaces 150 of the barbs 140 will clear the lock seats 158 of the channel grooves 142 providing clearance for the barbs 140 to exit the channel grooves 142. With the fingers flexed inward, and the threaded screw removed from the nozzle 102, the operator may withdraw the nozzle 102 from the nozzle socket 106. To assist removal, a tool, such as a regular head type screwdriver, may be inserted between a pry gap 166 of the nozzle socket 106 and a pry surface 168 of an outboard portion 170 of the nozzle 102 to exert a downstream directed pry force on the nozzle 102 to extract the nozzle 102 from the nozzle socket 106. When the finger grab tabs 164 are released, the lateral extensions 126 will return to their naturally outwardly biased orientation.

While the invention herein disclosed has been described by means of specific embodiments, examples and applications thereof, numerous modifications and variations could be made thereto by those skilled in the art without departing from the scope of the invention set forth in the claims.

What is claimed is:

1. A nozzle insert for an irrigation sprinkler, the nozzle insert comprising:

a nozzle body portion defining a water flow path having an upstream portion for mounting in a nozzle socket in flow communication with a supply of water under pressure, and a downstream portion defining a nozzle outlet for outward projection of a water stream to irrigate surrounding terrain;

a rim of the upstream portion defining an upstream opening through which water travels into the nozzle body portion; and a latching portion for inter-engaging with an irrigation sprinkler to form a detachable connection that prohibits unintentional removal of the nozzle insert, the latching portion comprising at least one axial extension extending axially upstream from the rim with the at least one axial extension being configured to engage the nozzle socket, the at least one axial extension having a terminal free latching end disposed upstream of the rim.

2. A nozzle insert in accordance with claim 1 wherein the latching portion is flexible in an inward direction to permit the nozzle insert to be inserted in a nozzle socket of an irrigation sprinkler.

3. A nozzle insert in accordance with claim 2 wherein the latching portion includes an outwardly extending protrusion for engaging a lock seat of a nozzle socket in forming the detachable connection.

4. A nozzle insert in accordance with claim 3 wherein the latching portion is flexible inward, whereby in the flexed state the outwardly extending protrusion passes can pass over a lock seat of a nozzle socket for facilitating intentional insertion and removal of the nozzle insert.

5. A nozzle insert in accordance with claim 1 wherein the at least one axial extension extends generally outwardly and axially upstream from an outer surface of the nozzle body portion, the at least one axial extension being flexible in an inward direction and wherein the axial extension is configured to form a detachable connection with a nozzle socket.

6. An irrigation sprinkler including the nozzle insert of claim 1, the irrigation sprinkler comprising:

a housing with an inlet for receiving pressurized fluid, the housing defining a first fluid flow path;

a riser assembly disposed in the housing and moveable between a retracted position and an elevated position;

the riser assembly including a stem and a turret mounted thereon for rotation, the stem and turret defining a second fluid flow path;

a nozzle socket defined by the turret;

the nozzle insert removably received in the nozzle socket and defining a third fluid flow path having the upstream portion in communication with said second fluid flow path for receiving water and the downstream portion defining the nozzle outlet for ejecting at least one stream of fluid outwardly from the riser assembly; and the nozzle insert latching portion interengaging with the nozzle socket and forming a detachable connection therewith for restricting unintentional discharge of the nozzle insert from the nozzle socket.

7. An irrigation sprinkler in accordance with claim 6 wherein the latching portion is flexible in an inward direction thereby forming a detachable connection with the nozzle socket.

8. An irrigation sprinkler in accordance with claim 7 wherein the nozzle socket includes a lock seat and the latching portion includes a protrusion that cams over the lock seat of the nozzle socket upon insertion of the nozzle insert into the nozzle socket, whereby the protrusion engages the lock seat of the nozzle socket and restricts unintentional discharge of the nozzle insert from the nozzle socket.

9. An irrigation sprinkler in accordance with claim 8 wherein the at least one axial extension is inwardly flexible to provide clearance for the protrusion to pass over the lock seat in a flexed state and to engage the lock seat in a released state upon insertion of the nozzle insert into the nozzle socket to form a snap-fit detachable connection.

10. An irrigation sprinkler in accordance with claim 9 wherein the at least one axial extension is in fluid communication with the flow path, whereby during operation of the irrigation sprinkler water under pressure exerts outward pressure on the at least one axial extension to restrict the axial extension from flexing inward disengaging the protrusion from the lock seat.

11. An irrigation sprinkler in accordance with claim 10 wherein the protrusion comprises an insertion cam surface to engage the nozzle socket and facilitate insertion of the nozzle insert and a lock surface to engage the lock seat during operation and restrict unintentional discharge of the nozzle insert and to facilitate removal of the nozzle insert.

12. The nozzle insert of claim 1 wherein the at least one axial extension comprises a pair of axial extensions extending axially upstream from the rim of the nozzle body portion.

13. The nozzle insert of claim 12 wherein the pair of axial extensions have terminal free latching ends disposed upstream of the rim and radial protrusions the of the terminal free latching ends for engaging a lock seat of a nozzle socket and forming the detachable connection.

14. A nozzle insert for an irrigation sprinkler, the nozzle insert comprising:

a nozzle body portion having a longitudinal axis and a through opening defining a water flow path along the longitudinal axis, the nozzle body portion having an upstream portion for mounting in a nozzle socket in fluid communication with a supply of water under pressure, and a downstream portion defining a nozzle outlet for outward projection of a water stream to irrigate surrounding terrain;

a wall of the upstream portion extending about the through opening, the wall having an inner surface;

a latching portion disposed upstream of the wall and connected thereto for inter-engaging with an irrigation sprinkler to form a detachable connection that prohibits unintentional removal of the nozzle insert;

an inner surface of the latching portion configured to be in fluid communication with the flow path so that during operation of the irrigation sprinkler water flows across the inner surface of the latching portion; and one or more grooves in the wall inner surface adjacent the connection between the latching portion and the wall, the one or more grooves being oriented to extend axially downstream of the connection along the water flow path, the one or more grooves configured to facilitate inward flexing of the latching portion.

15. The nozzle insert of claim 14 wherein the wall of the upstream portion comprises a generally tubular wall extending axially along the water flow path.

16. The nozzle insert of claim 14 wherein the latching portion comprises at least one axial extension extending substantially upstream of the nozzle body portion.

17. The nozzle insert of claim 16 wherein the at least axial extension comprises a pair of axial extensions extending substantially upstream of the nozzle body portion.

18. The nozzle insert of claim 14 wherein the latching portion includes an outwardly extending protrusion for engaging a lock seat of the nozzle socket.

19. The nozzle insert of claim 14 wherein the one or more grooves in the wall inner surface adjacent the connection between the latching portion and the wall comprise a pair of grooves oriented to extend axially downstream of the connection along the water flow path.

* * * * *